United States Patent [19]

Flowers et al.

[11] 4,454,187

[45] Jun. 12, 1984

[54] COMPOSITE LAMINATE MATERIAL AND PROCESS FOR MAKING THE SAME

[75] Inventors: Thomas A. Flowers, Royal Oak; Samuel D. Vinch, Lake Orion; Chandru T. Shahani, Sterling Heights, all of Mich.

[73] Assignee: Allen Industries, Inc., Troy, Mich.

[21] Appl. No.: 506,749

[22] Filed: Jun. 22, 1983

Related U.S. Application Data

[63] Continuation of Ser. No. 167,294, Jul. 10, 1980, abandoned.

[51] Int. Cl.[3] ..... B32B 3/26

[52] U.S. Cl. ..... 428/159; 156/78; 156/209; 156/220; 156/231; 156/238; 156/244.24; 264/45.9; 264/46.1; 264/48; 427/244; 428/158; 428/171; 428/172; 428/316.6

[58] Field of Search ..... 156/78, 209, 220, 231, 156/238, 244.24; 264/45.1, 45.9, 46.1, 48; 427/244; 428/158, 159, 171, 172, 316.6

[56] References Cited

U.S. PATENT DOCUMENTS

| | | | |
|---|---|---|---|
| 3,519,526 | 7/1970 | Carey et al. | 428/97 X |
| 3,714,078 | 1/1973 | Gordon et al. | 428/264 X |
| 4,035,215 | 7/1977 | Goldstone | 156/220 X |
| 4,053,670 | 10/1977 | Le Poutre | 156/220 X |
| 4,102,719 | 7/1978 | Fujii et al. | 156/231 X |

FOREIGN PATENT DOCUMENTS

| | | | |
|---|---|---|---|
| 7625395 | 7/1976 | Japan | 428/159 |

*Primary Examiner*—Robert A. Dawson
*Attorney, Agent, or Firm*—Joseph V. Tassone

[57] ABSTRACT

A composite laminate material and a process for making the same are provided, the process comprising the steps of providing an unbonded fibrous batt of desired thickness having a thermosetting binder material dispersed therethrough, applying a layer of desired thickness of a curable latex to at least one side of the fibrous batt, drying the layer to a predetermined moisture level to provide a dried composite material, and heating and compression molding the dried composite material to simultaneously mold the composite, cure the layer and cure the binder material by embossing a pattern into the exposed side of the layer before the layer and the binder material are cured to cause the layer to be contoured with the pattern substantially throughout the thickness thereof and thereby cause the pattern to be substantially impressed into one side of the batt so that the resulting embossed and cured layer has a substantially uniform thickness and the one side of the cured batt substantially conforms to the embossed contour of the layer.

14 Claims, 6 Drawing Figures

COMPOSITE LAMINATE MATERIAL AND PROCESS FOR MAKING THE SAME

This application is a continuation patent application of it copending parent patent application, Ser. No. 167,294, filed Jul. 10, 1980, now abandoned.

BACKGROUND OF THE INVENTION

The present invention relates to a novel decorative trim panel and process for making same.

Composite trim panels of the type to which the present invention is directed are in widespread commercial use in the manufacture of home furnishings, automotive interior trim, and the like. Such trim panels are particularly applicable to interior automotive trim including package trays, door panels and headliners. Conventionally, composite trim materials employed for the foregoing purposes include a decorative wear-resistant and abrasion-resistant facing sheet which is applied over an underlying resilient padding material, enhancing the feel and cushioning characteristics of the surfaces to which it is applied. It has been customary in the past to enhance the decorative characteristics of such trim materials by including localized depressed areas therein. Various techniques have heretofore been used or proposed to fabricate such trim materials, including stitching the facing sheet and pad material together along selected areas and dielectric heat fushion techniques for imparting a preselected pattern to such trim materials.

The various techniques heretofore used or proposed are each subject to inherent disadvantages, either in high cost, time-consuming operations required for imparting a desired pattern or lack of flexibility in selection of the various designs which can be incorporated in such trim panels. For example, the stitching of a facing sheet and a pad material to each other is an extremely costly and time-consuming operation, and the resulting composite material is characterized as allowing relative movement between the facing sheet and the underlying padding material in those areas devoid of any stitching, which generally results in wrinkling and an excessive wear rate of the composite material.

It is therefore an object of the present invention to provide an improved process for making a composite trim panel.

It is another object of this invention to provide an improved composite trim panel.

Other objects and advantages of the present invention will be apparent to those skilled in the art from the following description of the invention.

SUMMARY OF THE INVENTION

In accordance with the present invention there is provided an improved process for making a composite laminate material which comprises the sequential steps of providing an unbonded fibrous batt of desired thickness having a thermosetting resin dispersed therethrough, applying a layer of desired thickness of a cureable latex to at least one side of the fibrous batt, drying the layer, and compressing and heating the resuting dried layer and the batt to simultaneously mold the composite and cure the layer and the thermosetting resin in the batt by embossing a pattern into the exposed side of the layer before the layer and the resin are cured to cause the layer to be controured with the pattern substantially throughout the thickness thereof and thereby cause the pattern to be substantially impressed into the one side of the batt so that the resulting embossed and cured layer has a substantially uniform thickness and the one side of the cured batt substantially conforms to the embossed contour of the layer.

In accordance with another imbodiment of this invention, the cureable latex foam is first applied to a carrier material and this foam/carrier composite is then united with the fibrous batt.

Also provided in accordance with this invention is a decorative laminate material made according to the above process.

DETAILED DESCRIPTION OF THE DRAWING

Figure 1:
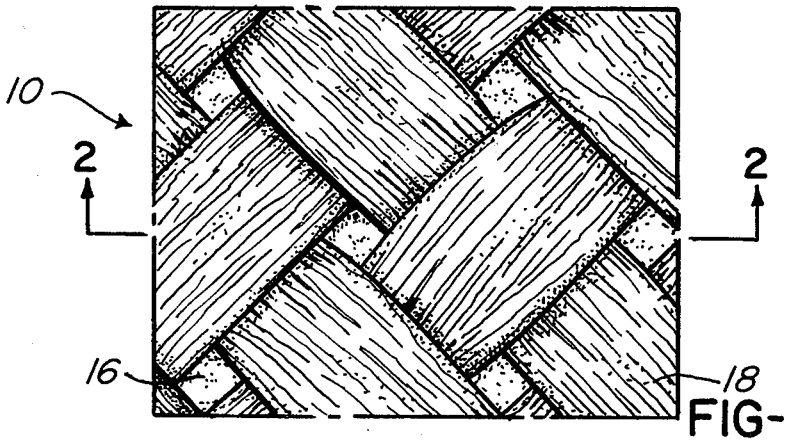
FIG. 1 is a fragmentary plan view of a composite panel made in accordance with one embodiment of the present invention.
Figure 2:
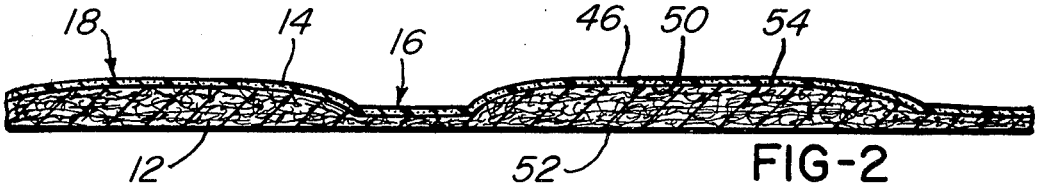
FIG. 2 is a cross-section taken along line 2—2 of FIG. 1.

One embodiment of the invention is illustrated in FIGS. 1 and 2. The composite panel 10 comprises a base 12 and a decorative surface layer 14. The panel 10 has fully compressed portions 16 and less compressed portions 18, these portions cooperating to provide a decorative surface pattern, as illustrated.

Figure 3:
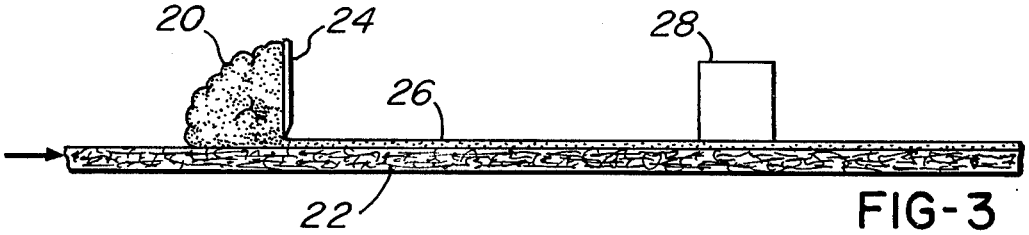
FIGS. 3-5 illustrate the steps of spreading a cureable foam onto a fibrous batt, then drying the foam.
Figure 4:
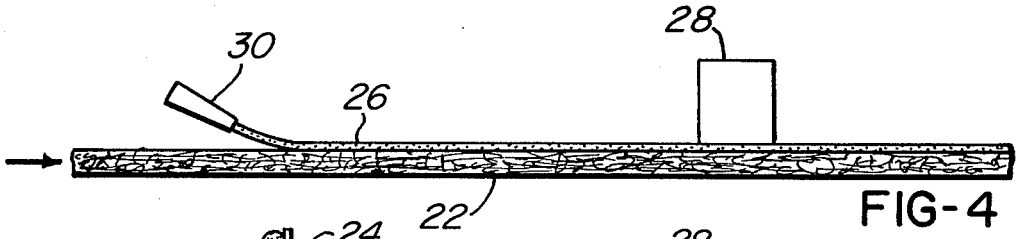
Figure 5:
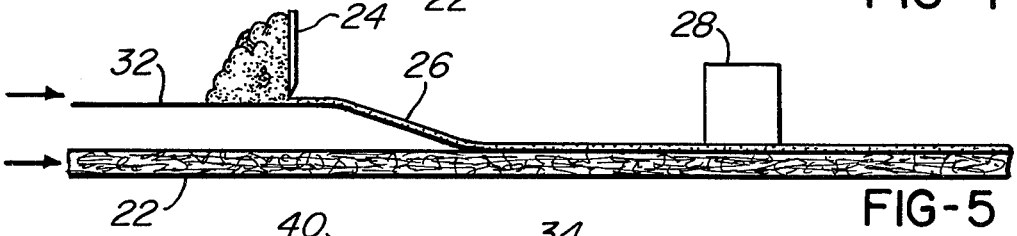

The composite panel 10 is made, as discussed previously, by first applying a layer of a cureable latex foam to a fibrous batt. The foam may be applied using a knife coater, as illustrated in FIG. 3, wherein a foam mass 20 is spread onto a continuous fabrous batt 22 using a coating knife 24 to provide a foam layer 26 of a desired thickness. The resulting composite of foam 26 and batt 22 is then passed into a drying oven 28 to dry the foam layer 26. The foam layer 26 may also be applied to the batt 22 by extruding the layer 26 using a foam extrusion apparatus 30, as illustrated in FIG. 4.

According to another embodiment of the invention, the foam layer 26 is spread, using a coating knife 24, onto a carrier material 32. The composite of the carrier 32 and foam layer 26 is then united with the fibrous batt 22 and the foam is thereafter dried, as described above.

Figure 6:
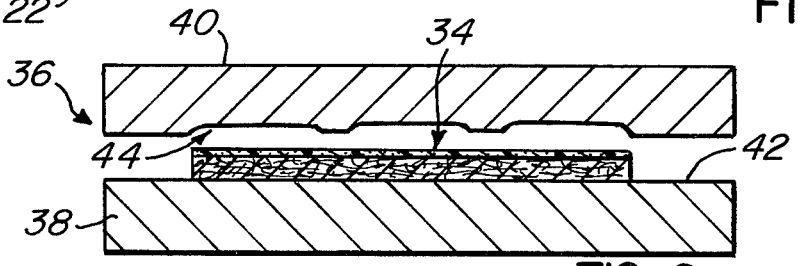
FIG. 6 illustrates the molding step of the process of this invention.

The composite of batt 22 and foam layer 26, or batt 22, carrier 32 and foam layer 26 is now ready for molding. Referring to FIG. 6, the omposite, hereinafter designated by the reference numeral 34, is placed in a molding apparatus 36 having a first platen 38 and a second platen 40. In the embodiment illustrated, the first platen 38 has a generally flat surface 42, and the second platen 40 has a decorative surface, designated generally by the reference numeral 44, in reverse of the desired decorative surface. When the molding apparatus is closed, the foam layer 26 and the batt 22 are both compressed to varying degrees, depending on the pattern of the surface 44. Following a suitable time in the mold, the apparatus 36 is opened and the completed panel 10 is removed.

Referring again to FIGS. 1 and 2, it can be seen that the exposed surface 46 of the compressed foam layer, i.e., the decorative surface layer 14, is embossed with the pattern 44 of the second platen 40. The opposite surface 50 of the layer 14 is generally smooth and although it does reflect the sharper divisions between the fully compressed portions 16 and the less compressed portions 18, the surface 50 does not fully take on the embossments present in the surface 46. The exposed surface 52 of the compressed batt, i.e., the base 12, is relatively flat, while the opposite surface 54 of the base 12 generally follows the contours of the decorative surface layer 14. It is also readily apparent from FIG. 2 that the compressed foam layer 14 is of relatively uniform thickness, as compared to the base 12.

The fibrous batt 22 comprises randomly arranged fibers of any of the types well known in the art including those of animal, vegetable or synthetic origin. Suitable fibers include naturally-occurring fibers of animal origin such as wool, silk, hair from cattle, horses and hogs, chicken feathers and the like; natural fibers of vegetable origin such as cotton, hemp, jute, ramie, sisal, cellulose, abaca and the like; and synthetic fibers such as cellulose acetate, viscose rayon, nylon, vinyl-chloride, glass fiber, and the like.

The formation of a continuous batt of the fibrous material is achieved in accordance with techniques well known in the art such as, for example, by passing the fibers through a suitable carding or garnetting machine, whereafter they pass through a suitable lapper in which an overlapping of the resultant fibrous web is accomplished until a batt of the desired thickness if obtained. Alternatively, a continuous batt may be formed using air-lay equipment.

The continuous batt is impregnated with a suitable binder material which functions to bond the fibers to each other at their points of contact. Suitable binder materials include any of those well known in the art which are compatible with the fibers employed and which provide a tenacious bond of the fibers. Various thermosetting binders have been found to be particularly satisfactory such as phenol aldehyde resins, urea resins, molamine resins and the like. The binder materials should have a curing temperature of about 225°–350° F.

The binder material may be applied to the web as it emerges from the garnetting machine and passes into the lapper, or it may be incorporated with the fibers as the batt is formed by an air-lay machine. Conventionally, the fibrous batt is formed so as to have a resultant density of from about one to about five ounces per square foot and may be of a thickness ranging from about ¼ to about 1½ inches. The amount of binder material incorporated with the fibrous material may range from about 10 to about 30 weight percent, based upon the weight of fibrous material.

The carrier material 32 may be any material, woven or non-woven, onto which the cureable latex foam can be applied in a relatively uniform manner and which is sufficiently open, so that, during the molding step, a portion of the latex foam can pass through the interstices in the carrier material and physically bond to the fibers of the fibrous batt. The carrier material may be made from any natural or synthetic fiber.

The cureable latex foam may be any vulcanizable, or otherwise, heat cureable, natural or synthetic latex capable of forming the desired deocrative laminate material under the conditions employed. Typical synthetic latices include hot and cold SBR latices, SB resin latices, nitrile latices, vinyl pyridine latices, acrylic latices, polychloroprene latex and isoprene latex, and blends thereof. Two presently preferred latices are acrylic latices and nitrile latices.

A typical foamable latex recipe is as follows:

| | Parts by Weight (Dry Basis) |
|---|---|
| Latex | 100 |
| Emulsifying Agent | 0.5–4 |
| Plasticizer | 0–15 |
| Filler | 0–40 |
| Thickener | 0.1–1.0 |
| Foam Stabilizer | 1–5 |
| Crosslinking Agent | 1–10 |
| Water | 0–50 |

The above ingredients are compounded using conventional techniques and apparatus. The foamable latex is then mechanically frothed using conventional techniques and apparatus. The resulting foam is applied in a layer ranging in thickness from about 0.05 to about 0.5 inch, using the application techniques previously discussed.

The latex foam is dried using conventional foam drying techniques to a moisture level of about 10 percent or less, preferably about 3 percent or less. The drying temperature may range from about 250° to about 350° F. (120°–175° C.), and drying time may range from about 50 to about 20 minutes, depending upon the foam thickness and the initial moisture level. It is highly desirable that the drying conditions be selected so as to dry the foam to the desired residual moisture level without prematurely activating the binder material in the fibrous batt. Depending upon the type of latex employed, it may be desirable to heat the foam for a time sufficient to partially crosslink the foam.

The composite material is molded at a temperature ranging from about 225° to about 450° F. (105° to 230° C.) for a time ranging from about 15 to about 120 seconds. During the molding step, the foam is compressed and then cured, and, simultaneously, the fibrous batt is compressed and the binder material therein is then cured. At the end of the molding cycle, the mold is opened and the completed part is removed. One advantage resulting from applying the latex foam to the fibrous batt, as compared to applying foam to a previously densified batt, is that there is some impregnation of the batt, and during the molding and curing step, the foam is physically linked to the batt.

The completed part may be colored, in a desired manner, by painting the same after molding, or the foam layer may be pigmented by substituting one or more pigments for the filler, mentioned previously.

Various modifications and variations of this invention will be apparent to those skilled in the art and are intended to be included within the scope and purview of this application and the scope of the appended claims.

We claim:

1. A process for making a composite laminate material which comprises the steps of (a) providing an unbonded fibrous batt of desired thickness having a thermosetting binder material dispersed therethrough;

(b) applying a layer of desired thickness of a cureable latex to at least one side of said fibrous batt;

(c) drying said layer to a predetermined moisture level to provide a dried composite material; and (d) heating and compression molding said dried composite material to simultaneously mold said composite, cure said layer and cure said binder material by embossing a pattern into the exposed side of said layer before said layer and said binder material are cured to cause said layer to be contoured with said pattern substantially throughout the thickness thereof and thereby cause said pattern to be substantially impressed into said one side of said batt so that the resulting embossed and cured layer has a substantially uniform thickness and said one side of said cured batt substantially conforms to the embossed contour of said layer.

2. The process of claim 1 wherein said latex is a foam and is applied to said batt by knife-coating said foam onto said batt.

3. The process of claim 1 wherein said latex is a foam and is applied to said batt by extruding said foam onto said batt.

4. The process of claim 1 wherein said latex is a foam and is applied to said batt by knife-coating said foam onto a carrier material and thereafter uniting said carrier material, having said foam layer thereon, with said batt.

5. The process of claim 1 wherein said latex is a foam that is dried to a moisture level of not greater than about 10 percent.

6. The process of claim 1 wherein said latex is a foam that is dried to a moisture level of not greater than about 3 percent.

7. The process of claim 1 wherein said latex is a foam that is dried at a drying temperature in the approximate range of 250° to 350° F. for a time in the approximate range of 5 to 20 minutes.

8. The process of claim 7 wherein said foam is heated during said foam drying step for a time sufficient to partially crosslink said foam.

9. The process of claim 1 wherein said cureable latex is an acrylic latex.

10. The process of claim 1 wherein said cureable latex is a nitrile latex.

11. The product of the process of claim 1.

12. The process of claim 1 wherein said step of heating and compression molding comprises the steps of disposing said composite material between a first platen and a second platen, and bringing said platens together to mold said composite material therebetween.

13. The process of claim 12 wherein said step of disposing said composite material comprises the step of disposing the exposed side of said batt onto a surface of said second platen, said step of bringing said platens together causing a decorative surface of said first platen to be embossed into said exposed side of said layer whereby the exposed side of the resulting cured batt has the contour of said surface of said second platen.

14. The process of claim 13 wherein said surface of said second platen is substantially flat whereby said cured batt has the exposed side thereof formed substantially flat.

* * * * *